US006172465B1

(12) United States Patent
Huang

(10) Patent No.: US 6,172,465 B1
(45) Date of Patent: Jan. 9, 2001

(54) METHOD FOR DRIVING PLASMA DISPLAY

(75) Inventor: Jih-Fon Huang, Hsinchu (TW)

(73) Assignee: Acer Display Technology Inc., Hsinchu (TW)

( * ) Notice: Under 35 U.S.C. 154(b), the term of this patent shall be extended for 0 days.

(21) Appl. No.: 09/443,601

(22) Filed: Nov. 19, 1999

(30) Foreign Application Priority Data

Nov. 20, 1998 (TW) ..... 87119219

(51) Int. Cl.[7] ..... G09G 3/20
(52) U.S. Cl. ..... 315/169.3; 345/55; 345/76
(58) Field of Search ..... 315/169.3, 160, 315/169.1; 345/55, 76, 89

(56) References Cited

U.S. PATENT DOCUMENTS 5,998,414 * 4/1999 Awamoto et al. ..... 345/55

* cited by examiner

*Primary Examiner*—David Vu
(74) *Attorney, Agent, or Firm*—Raymond Sun

(57) ABSTRACT

A method for driving a plasma display is provided. The method includes the steps of (a) executing a reset discharge for all cells of the odd-numbered scanning line of the plasma display, (b) executing an addressing discharge for all cells of the odd-numbered scanning line, (c) executing a sustaining discharge for all cells of the odd-numbered scanning line, (d) executing a reset discharge for all cells of the even-numbered scanning line of the plasma display, (e) executing an addressing discharge for all cells of the even-numbered scanning line, and (f) executing a sustaining discharge for all cells of the even-numbered scanning line of the plasma display. The method is used to reduce the abrupt change of image brightness and the dynamic false contour of the image, and further improve the quality of the moving pictures.

3 Claims, 8 Drawing Sheets

METHOD FOR DRIVING PLASMA DISPLAY

FIELD OF THE INVENTION

The present invention relates to a method for driving a plasma display, and more particularly to a method for reducing dynamic false contour of the plasma display.

BACKGROUND OF THE INVENTION

Recently, due to the fast development in electro-optic techniques, the related studies and techniques of the plasma display panel (to be abbreviated as PDP here below) have grown rapidly and compatible with multimedia applications. The advantages of PDP, in contrast to liquid crystal displays now in use, include better moving picture quality and image display characteristics. In addition, the thickness of a PDP is much thinner than that of a conventional cathode ray tube (CRT) television set. The PDP thus catches the eyes of scientists and researchers and have become a popular field of research. We believe that PDP will soon become popular for home use replacing the traditional CRT displays.

In general, one field for displaying one frame is divided to a plurality of sub-fields, and a PDP represents gray scale with sub-fields. That is, different light emission time of discharging in each sub-field is used to display different bright brightness of a pixel. Please refer to FIG. 1 showing the sequence of sub-fields used in the prior art. Typically, one field includes eight sub-fields ranging from $SF_0$ to $SF_7$, and the brightness levels of brightness are divided to $2^8$, that is, 256 grades. Each sub-field signal comprises an address period, a sustain period, and a reset period. The sustain periods of these sub-fields $SF_0$, $SF_1$, $SF_2$, $SF_3$, $SF_4$, $SF_5$, $SF_6$, and $SF_7$, are at a ratio of 1:2:4:8:16:32:64:128. The 256 intensity levels are achieved by selectively combining the sub-fields to turn the PDP on.

Nevertheless, the abrupt change of image brightness appears when the brightness level of the image is changed. For instance, a signal having a brightness level 128 is on the left of the emitting pattern and a signal having a brightness level 127 is on the right of the emitting picture. When an image is moved from left direction to right direction, the abrupt change of image brightness will appear and further lead to a dynamic false contour in a certain part of the image. Therefore, it is inconvenient and inefficient for applications and has a lot to be improved.

SUMMARY OF THE INVENTION

In order to overcome the problem discussed above, a method for driving plasma display panel to avoid the abrupt change of image brightness and the distortion of dynamic image contour.

Accordingly, an object of the present invention is to provide a method for improving the moving picture quality.

Another object of the present invention is to provide a method for eliminating the dynamic false contour of a PDP.

Moreover, it is still another object of the present invention to provide a driving method for avoiding the abrupt change of image brightness.

Furthermore, it is still another object of the present invention to provide a circuit of a PDP for avoiding the abrupt change of image brightness and reducing the distortion of dynamic image contour.

To accomplish the foregoing objects, the present invention provides a method for driving a plasma display panel (PDP) in which the sub-field signals of the odd-numbered scanning lines are first applied and the sub-field signals of the even-numbered scanning lines are later applied. The plasma display panel has a first substrate and a second substrate facing each other. At least two scanning lines are formed on the first substrate and sequentially numbered as either one of an odd-numbered scanning line and an even-numbered scanning line, each of the scanning lines has a first electrode and a second electrode disposed in parallel with each other. A plurality third electrodes are disposed on the second substrate and extending orthogonally to the first and second electrode for defining a cell among each first, second, and third electrode. The first electrode and second electrode of the odd-numbered scanning line is defined as an odd-numbered first electrode and an odd-numbered second electrode, and first electrode and second electrode of the even-numbered scanning line is defined as an even-numbered first electrode and an even-numbered second electrode. A light emission is executed by carrying out a addressing discharge utilizing a memory function for cells of these scanning lines and by carrying out a sustain discharge for sustaining the addressing discharge.

According to the present invention, the driving method includes steps of (a) executing a reset discharge for all cells of the odd-numbered scanning line by applying reset signals on the odd-numbered first electrode and the odd-numbered second electrode, (b) executing the addressing discharge for all cells of the odd-numbered scanning line selected by either one of the odd-numbered first electrode and the odd-numbered second electrode to receive addressing signals from the third electrode, and (c) executing the sustaining discharge for all cells of the odd-numbered scanning line by alternatively applying driving signals on either one of the odd-numbered first electrode and the odd-numbered second electrode. The method further includes steps of (d) executing a reset discharge for all cells of the even-numbered scanning line by applying reset signals on the even-numbered first electrode and the even-numbered second electrode, (e) executing said addressing discharge for all cells of the even-numbered scanning line selected by either one of the even-numbered first electrode and the even-numbered second electrode to receive addressing signals from the third electrode, and (f) executing said sustaining discharge for all cells of the even-numbered scanning line by alternatively applying driving signals on either one of the even-numbered first electrode and the even-numbered second electrode.

In the meantime, the present invention further provides a signal circuit including a timing controller used to determine the clock pulses for the driving signals of the sub-fields, a scanning driver of scanning lines connected to the timing controller for generating the scanning line signals, and a scanning driver for sustaining scanning lines that is connected to the timing controller and used to sustain the scanning line signals. The signal circuit further includes a data driver connected to the timing controller for driving the data of the image signals.

BRIEF DESCRIPTION OF THE DRAWINGS

The object, spirit and advantages of the present invention will be readily understood by the accompanying drawings.

DETAILED DESCRIPTION OF THE INVENTION

Typically, a plasma display panel (PDP) has a first substrate and a second substrate facing each other. At least two scanning lines are formed on the first substrate and sequentially numbered as either one of an odd-numbered scanning line and an even-numbered scanning line. Each of the scanning lines has a first electrode and a second electrode disposed in parallel with each other. A plurality of third electrodes are disposed on the second substrate and extending orthogonally to the first and second electrode for defining a cell among each first, second, and third electrode. The first electrode and second electrode of the odd-numbered scanning line is defined as an odd-numbered first electrode and an odd-numbered second electrode, and first electrode and second electrode of the even-numbered scanning line is defined as an even-numbered first electrode and an even-numbered second electrode. A light emission is executed by carrying out a addressing discharge utilizing a memory function for cells of these scanning lines and by carrying out a sustain discharge for sustaining the addressing discharge.

In the present invention, the method for driving the PDP includes steps of (a) executing a reset discharge for all cells of the odd-numbered scanning line by applying reset signals on the odd-numbered first electrode and the odd-numbered second electrode, (b) executing the addressing discharge for all cells of the odd-numbered scanning line selected by either one of the odd-numbered first electrode and the odd-numbered second electrode to receive addressing signals from the third electrode, and (c) executing the sustaining discharge for all cells of the odd-numbered scanning line by alternatively applying driving signals on either one of the odd-numbered first electrode and the odd-numbered second electrode. The method further includes steps of (d) executing a reset discharge for all cells of the even-numbered scanning line by applying reset signals on the even-numbered first electrode and the even-numbered second electrode, (e) executing said addressing discharge for all cells of the even-numbered scanning line selected by either one of the even-numbered first electrode and the even-numbered second electrode to receive addressing signals from the third electrode, and (f) executing said sustaining discharge for all cells of the even-numbered scanning line by alternatively applying driving signals on either one of the even-numbered first electrode and the even-numbered second electrode.

Figure 1:
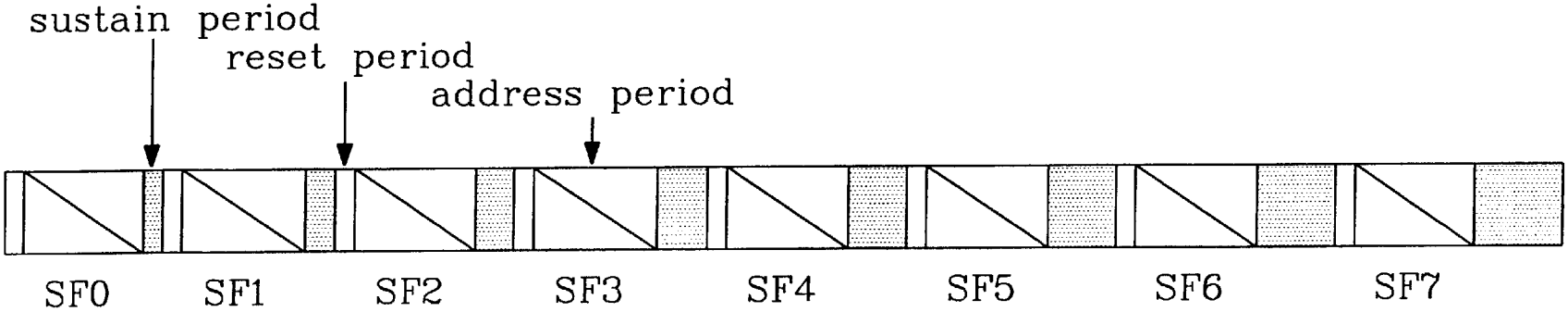
FIG. 1 (PRIOR ART)
FIG. 1 is a schematic diagram illustrating the sequence of sub-field in a plasma display panel (PDP) of the prior art.
Figure 2A:
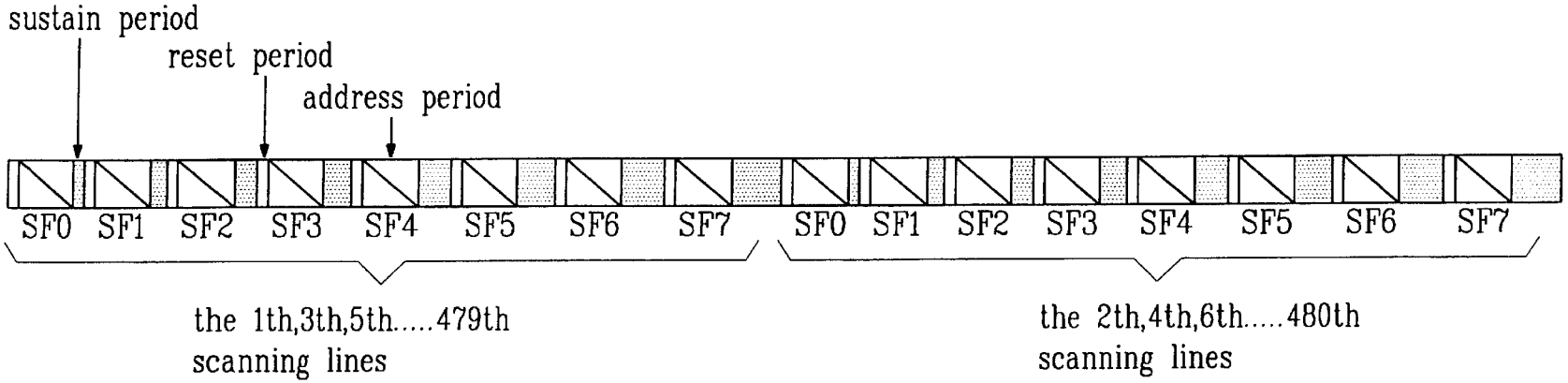
FIG. 2A is a schematic diagram illustrating the sequence of sub-field signals of the odd-numbered scanning signals and the even-numbered scanning signals according to the first embodiment of the present invention.

Please refer to FIG. 2A which is a diagram illustrating the sequence of sub-field signals. The scanning lines of the PDP are divided into to two groups including the odd-numbered scanning lines and the even-numbered scanning lines. The odd-numbered scanning lines include 1st, 3rd, 5th, . . . , 479th lines, and the even-numbered scanning lines include 2nd, 4th, 6th, . . . , 478th lines. The major difference between the present invention and the prior art is that the eight sub-field signals of the odd-numbered scanning lines are first applied onto the corresponding cells of the odd-numbered scanning lines, and the eight sub-field signals of the even-numbered scanning lines are later applied onto the corresponding cells of the even-numbered scanning lines. In the first steps for "applying the first sub-field signal $SF_0$" onto the odd-numbered scanning lines, the detailed actions includes: (1) all cells of the odd-numbered scanning lines are executed a reset discharge by applying reset signals on the odd-numbered first electrode and the odd-numbered second electrode, (2) all cells of the odd-numbered scanning lines are executed an addressing discharge which is selected by either one of the odd-numbered first electrode and the odd-numbered second electrode to receive addressing signals from each third electrode, and (3) finally, all cells of the odd-numbered scanning line are executing the sustaining discharge by alternatively applying driving signals on either one of the odd-numbered first electrode and the odd-numbered second electrode. Afterwards, the other sub-field signals $SF_1$~$SF_7$ of the odd-numbered scanning lines are sequentially applied according to the steps described above. After the eight sub-field signals $SF_0$~$SF_7$ of the odd-numbered scanning lines have been applied, the first sub-field signal $SF_0$ of the even-numbered scanning line is applied then.

Assumed the brightness level of the first scanning line is 128 and the brightness level of the second scanning line is 127. According to the present invention, the sub-field light emission of the second scanning line is executed only after all the sub-field light emissions of the first line have been completed. When the video image is moving, the abrupt change of image brightness will be reduced because the brightness level of the image is not directly changed from brightness level 128 to 127. Therefore, the dynamic false contour in a certain part of the image will not appear.

Figure 2B:
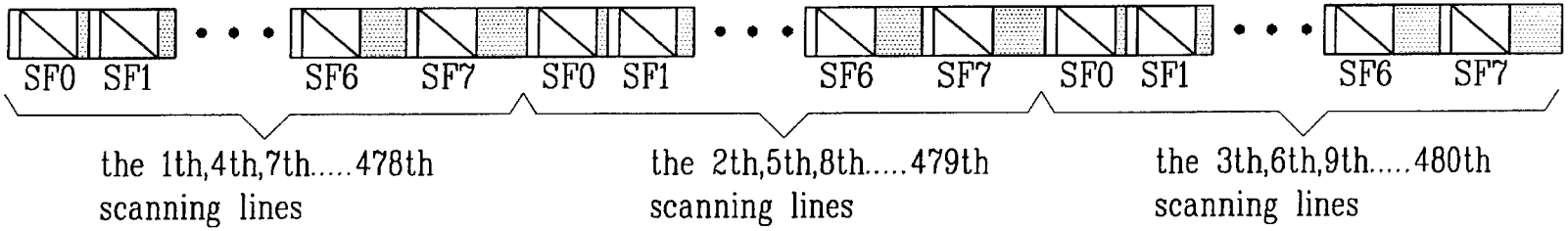
FIG. 2B is a schematic diagram illustrating the sequence of sub-field signals including three sets of scanning line signals in accordance with the first embodiment of the present invention.

Referring to the modified first embodiment shown as FIG. 2B, all scanning lines are divided into three sets. The first set of scanning lines includes 1st, 4th, 7th, . . . , 478th scanning lines, the second set includes 2nd, 5th, 8th, . . . , 479th scanning lines, and the third set includes 3rd, 6th, 9th, . . . , 480th scanning lines. The first sub-field $SF_0$ in all cells of the first set of scanning lines are reset, addressed, and sustained first. The second sub-field $SF_1$ in all cells of the first set of scanning lines are reset, addressed, and sustained later. After the eight sub-field signals $SF_0$~$SF_7$ of the first set of scanning lines have been sequentially applied, the eight sub-field signals $SF_0$~$SF_7$ of the second set of scanning lines are then applied. After the eight sub-field signals $SF_0$~$SF_7$ of the second set of scanning lines have been sequentially applied, the eight sub-field signals $SF_0$~$SF_7$ of the third set of scanning lines are applied. The sequence of the sub-fields illustrated in FIG. 2B has more flexibility, provides a better driving method for dynamic images and thus reduce the dynamic false contour.

Figure 3:
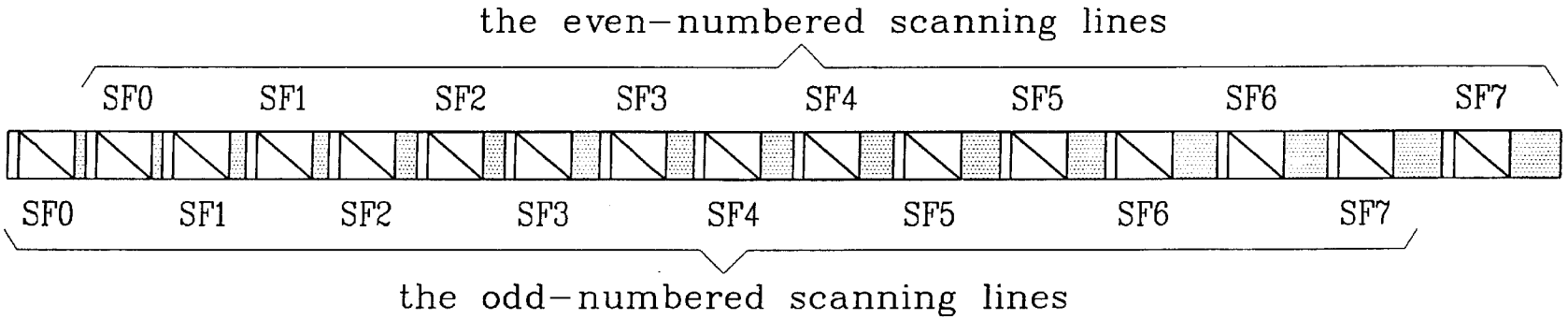
FIG. 3 is a schematic diagram illustrating the interlacing sequence of sub-field signals in accordance with the second embodiment of the present invention.

Please refer to FIG. 3 showing the sequence of sub-field signals in accordance with the second embodiment of the present invention. In the beginning, the first sub-field signal $SF_0$ of the odd-numbered scanning lines are applied onto the odd-numbered scanning lines to reset, address, and sustain the corresponding cells first. Afterwards, different from the sequence in FIG. 2A, the first sub-field signal $SF_0$ of the even-numbered scanning lines are applied onto the even-numbered scanning lines to reset, address, and sustain the corresponding cells. Then, the second sub-field signal $SF_1$ of the odd-numbered scanning lines is applied. Afterwards, the second sub-field signal $SF_1$ of the even-numbered scanning lines is applied. The eight sub-field signals $SF_0$~$SF_7$ in all cells of the odd-numbered and even-numbered scanning lines are applied in similar way. Therefore, the abrupt change of image brightness and the distortion of dynamic image contour that appear in the PDP of the prior art can be reduced.

Figure 4:
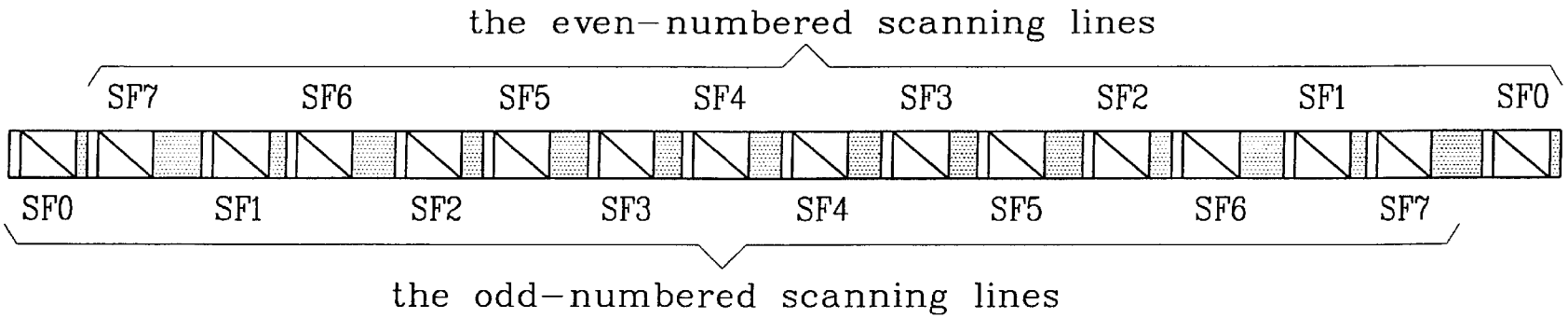
FIG. 4 is a schematic diagram illustrating the interlacing sequence of sub-field signals in accordance with the third embodiment of the present invention.

Refer to FIG. 4, another sequence of sub-field signals is shown according to the third embodiment of the present invention. First, the first sub-field signal $SF_0$ of the odd-numbered scanning lines is applied onto the odd-numbered scanning line. Secondly, different from the sequences in FIG. 3, the eighth sub-field signal $SF_7$ of the even-numbered scanning lines are then applied. Then, the second sub-field signal $SF_1$ of the odd-numbered scanning lines is applied. Afterwards, the seventh sub-field $SF_6$ of the even-numbered scanning lines is applied. Finally, the eight sub-field signals $SF_0$~$SF_7$ in all cells of the odd-numbered even-numbered scanning lines are applied in similar way. Therefore, the abrupt change of image brightness and the distortion of dynamic image contour that appear in the PDP of the prior art can be reduced.

Figure 5:
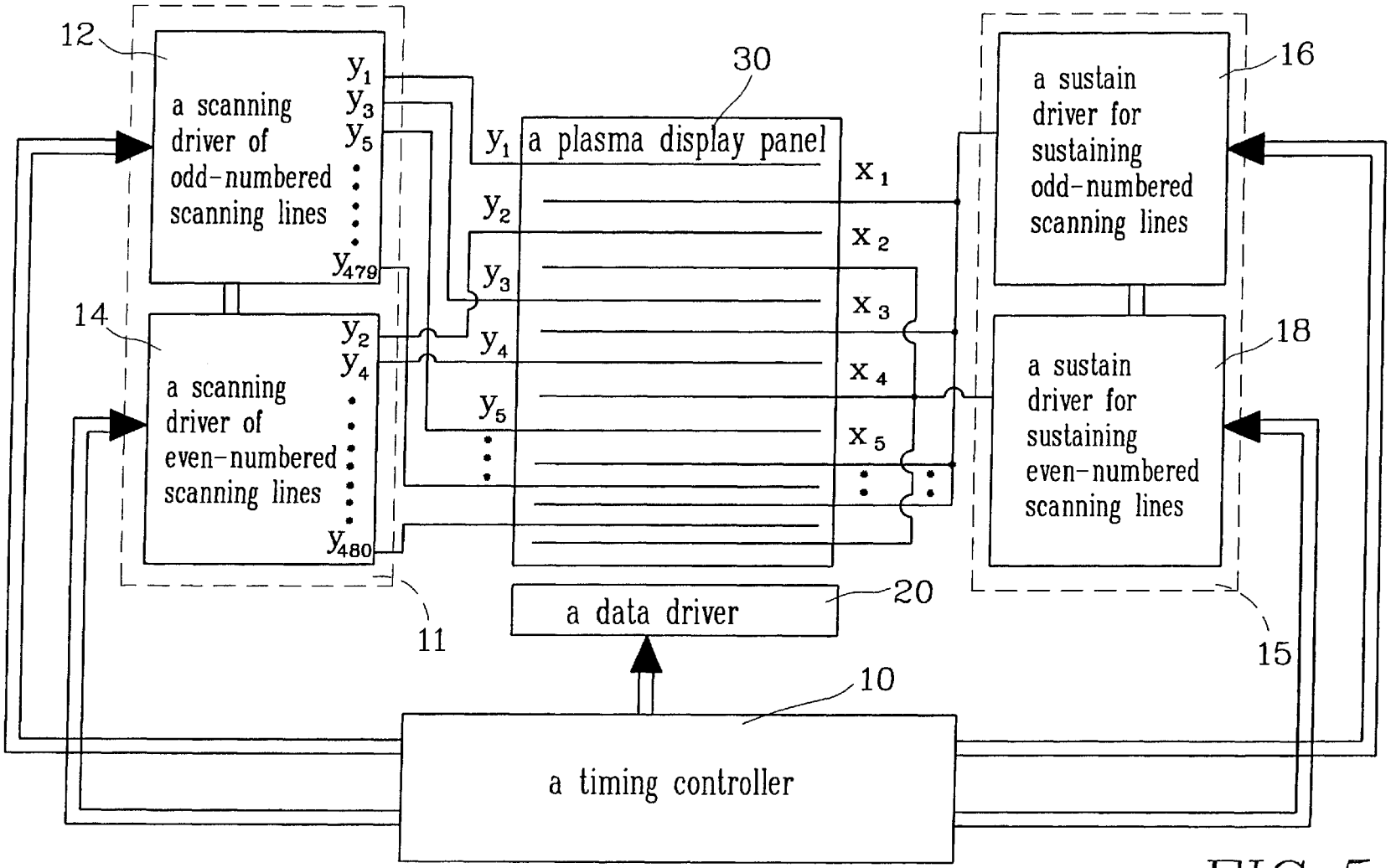
FIG. 5 is a schematic block diagram illustrating the signal circuit for the driving the interlacing sub-field signals of the present invention.

A signal circuit of the method for driving the PDP is shown in FIG. 5. The circuit includes a timing controller 10 for outputting the clock pulses for driving the sub-fields and controlling the image signal. A scanning driver 11 for generating scanning line signals is connected to one end of the timing controller 10. A sustain driver 15 for sustaining scanning lines signals is connected to the other end of the timing controller 10. The output signals of the scanning driver 11 and the sustain driver 15 are outputted the plasma display panel (PDP) 30 for displaying the image. A data driver 20 is connected to the timing controller 10 for receiving the data driving signal outputted from the timing controller 10 and driving the data essential for the image.

As shown in FIG. 5, the scanning driver 11 includes a scanning driver of odd-numbered scanning lines 12 and a scanning driver of even-numbered scanning lines 14. The scanning driver of odd-numbered scanning lines 12 receives the driving signal for scanning the odd-numbered scanning lines outputted from the timing controller 10. In addition, the scanning driver of even-numbered scanning lines 14 receives the driving signal for scanning the even-numbered scanning lines outputted from the timing controller 10. The sustain driver 15 includes a first sustain driver for sustaining odd-numbered scanning lines 16 and a sustain driver for sustaining even-numbered scanning lines 18. The sustain driver for sustaining odd-numbered scanning lines 16 is connected to the timing controller 10 and receives the signal for sustaining odd-numbered scanning lines. The sustain driver for sustaining even-numbered scanning lines 18 is connected to the time sequence controller 10 and receives the signal for sustaining even-numbered scanning lines.

However, in order to match the sequence in which there are three sets of scanning lines as illustrated in FIG. 2B, the circuit diagram as shown in FIG. 5 can be replaced by one in which there are three scanning drivers of scanning lines. In other words, the scanning driver 11 comprises a first scanning driver of scanning lines (for lines 1, 4, 7, . . . ), a second scanning driver of scanning lines (for lines 2, 5, 8, . . . ), and a third scanning driver of scanning lines (for lines 3, 6, 9, . . . ) (not shown). Similarly, the sustain driver 15 as shown in FIG. 5 can be replaced by one that is composed of a first scanning line driver (for lines 1, 4, 7, . . . ), a second scanning line driver (for lines 2, 5, 8, . . . ), and a third scanning line driver (for lines 3, 6, 9, . . . ).

Figure 6:
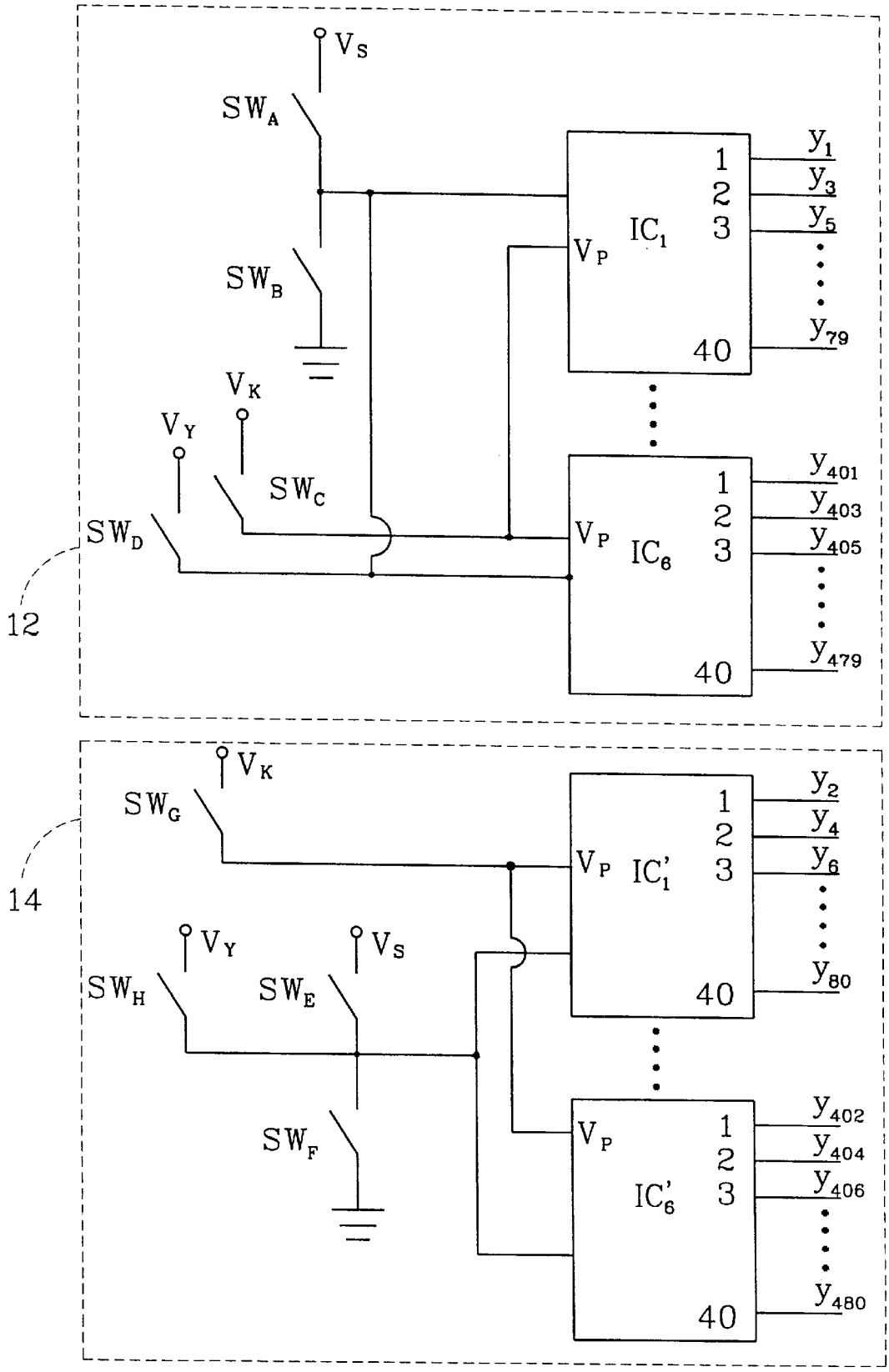
FIG. 6 is a schematic circuit diagram illustrating the scanning driver of odd-numbered scanning lines and the scanning driver of even-numbered scanning lines in the signal process circuit of the present invention.

Please refer to FIG. 6 showing the internal circuits of the scanning driver of odd-numbered scanning lines 12 and the scanning driver of even-numbered scanning lines 14. The scanning driver of odd-numbered scanning lines 12 includes a plurality of signal driving integrated circuits (IC's) ranging from $IC_1$ to $IC_6$, and two sets of switches $SW_A$, $SW_B$ and $SW_C$, $SW_D$. The output signals of $IC_1$ include $Y_1$, $Y_3$, . . . , $Y_{79}$, and the output signals of $IC_6$ include $Y_{401}$, $Y_{403}$, . . . , $Y_{479}$. The switches $SW_A$ and $SW_B$ are serially connected and are further connected to the source input terminals of the integrated circuits ranging from $IC_1$ to $IC_6$. The other end of the switch $SW_A$ is connected to the voltage source $V_S$, and the other end of the switch SWB is grounded. Furthermore, the switch $SW_C$ is connected to a voltage signal $V_K$, and further connected to the integrated circuits $IC_1$ to $IC_6$. Similarly, one end of the switch $SW_D$ is connected to a voltage signal $V_Y$, and further connected to the integrated circuits $IC_1$ to $IC_6$.

The scanning driver of odd-numbered scanning lines 14 is also constructed as the same manner. The scanning driver of even-numbered scanning lines 14 includes a plurality of signal driving integrated circuits (IC's) ranging from $IC_1'$ to $IC_6'$, of which the input terminals are connected to a set of serially connected switches $SW_E$ and $SW_F$. One end of the switch $SW_E$ is connected to the voltage source $V_S$, and one end of the switch $SW_F$ is grounded. The output signals of $IC_1'$ include $Y_2$, $Y_4$, . . . , $Y_{80}$, and the output signals of $IC_6$ include $Y_{402}$, $Y_{404}$, . . . , $Y_{480}$. Furthermore, the switch $SW_G$ is connected to a voltage signal $V_K$ and further connected to the integrated circuits $IC_1'$ to $IC_6'$. Similarly, the switch $SW_D$ is connected to a voltage signal $V_Y$ and further connected to the integrated circuits $IC_1'$ to $IC_6'$.

Figure 7:
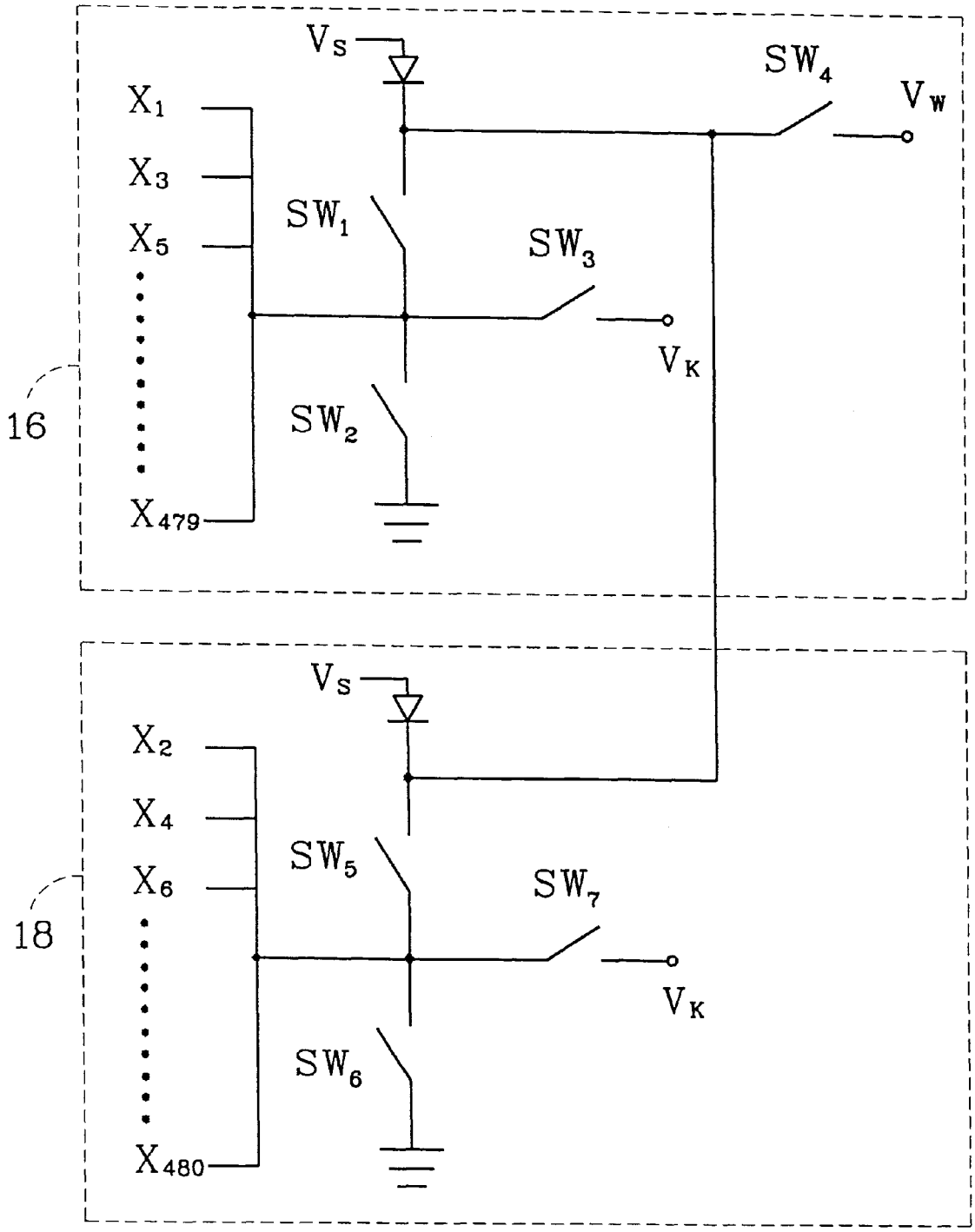
FIG. 7 is a schematic circuit diagram illustrating the scanning driver for sustaining odd-numbered scanning lines and the scanning driver for sustaining even-numbered scanning lines in the signal process circuit of the present invention.

Please refer to FIG. 7 showing the internal circuits of the sustain driver of sustaining odd-numbered scanning lines 16 and the sustain driver for sustaining even-numbered scanning lines 18. The sustain driver for sustaining odd-numbered scanning lines 16 includes a pair of signal switches $SW_1$ and $SW_2$ that are serially connected and are respectively connected to the voltage signals $V_W$ and $V_K$. The output signals of the sustain driver 16, including $X_1$, $X_3$, . . . , $X_{479}$, are connected with the switches $SW_1$ and $SW_2$. The sustain driver 16 further includes switches $SW_3$ and $SW_4$ that are respectively connected to the voltage signals $V_K$ and $V_W$. One end of the signal switch $SW_2$ is connected to the ground, and one end of the signal switch $SW_1$ is connected to a diode that is serially connected to the voltage source $V_S$.

Furthermore, the scanning driver for sustaining even-numbered scanning lines 18 includes a pair of signal switches $SW_5$ and $SW_6$ that are serially connected. The switch $SW_5$ is connected to a diode that is serially connected to the voltage source $V_S$, and further connected with the switch $SW_4$. One end of the signal switch $SW_6$ is connected to the ground. The sustain driver 18 further includes a switch $SW_7$ connected to the voltage signals $V_K$. The output signals of the sustain driver 18, including $X_2$, $X_4$, . . . , $X_{480}$, are connected with the switches $SW_5$ and $SW_6$.

Figure 8:
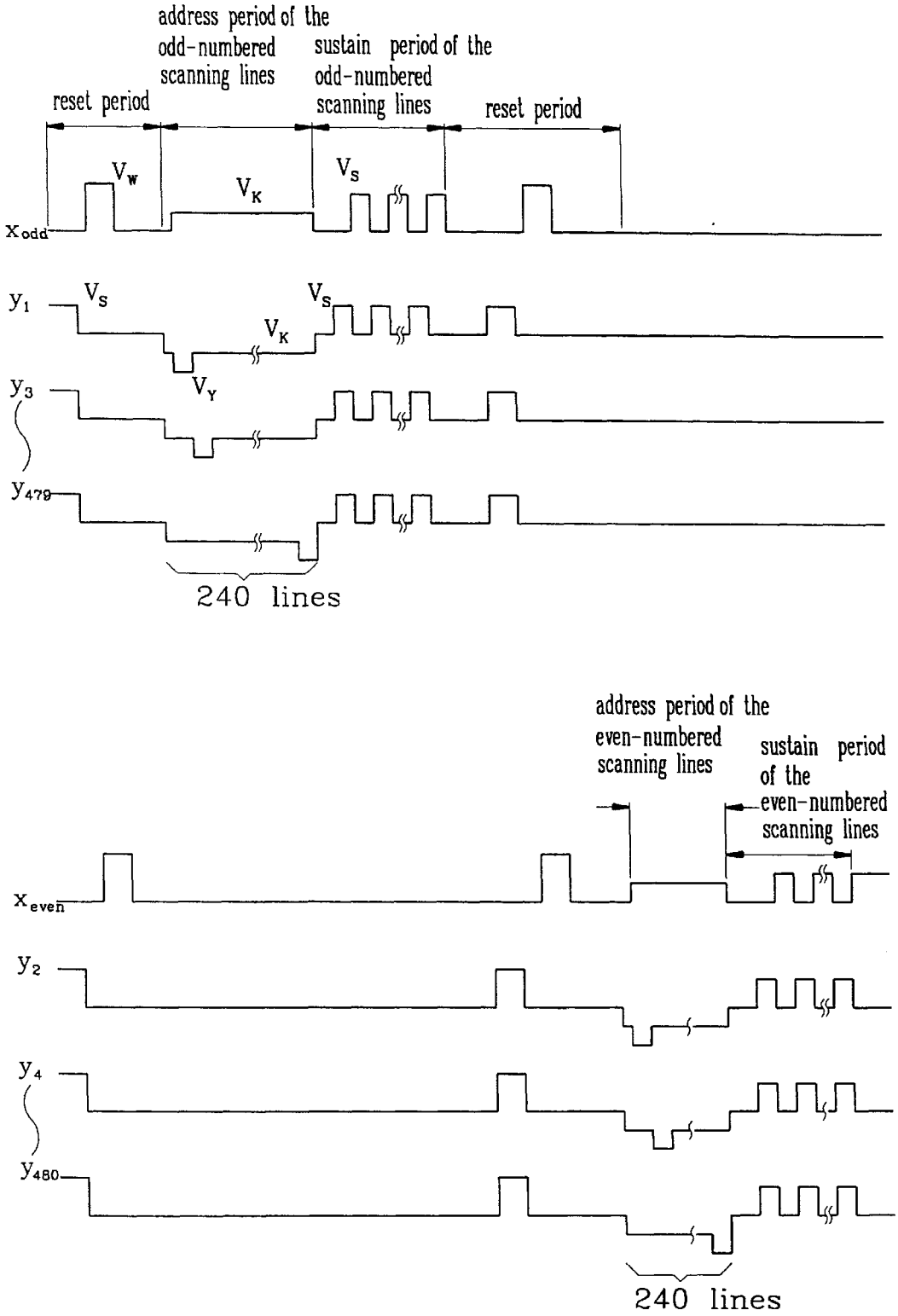
FIG. 8 is a schematic timing diagram illustrating the output waveforms of the scanning driver of scanning lines and the scanning driver for sustaining scanning lines in accordance with the present invention.

Please refer to FIG. 8 showing the output waveforms of the scanning driver 11 and the sustain driver 15 of the present invention. As shown in the drawing, $X_{odd}$ represents the output signal of the sustain driver for sustaining odd-numbered scanning lines 16 for sustaining the odd-numbered scanning line signals of the sub-fields, and $Y_1$, $Y_3$, . . . , $Y_{479}$ represent the output signals of the scanning driver of odd-numbered scanning lines 12. $X_{even}$ represents the output signal of the sustain driver for sustaining even-numbered scanning lines 18, and $Y_2$, $Y_4$, . . . , $Y_{480}$ represent the output signals of and the scanning driver of even-numbered scanning lines 14. Moreover, each odd-numbered scanning line signal includes an address period and a sustain period. Similarly, each even-numbered scanning line signals includes an address period and a sustain period. A reset period is positioned before the address period for removing all the signals. As shown in FIG. 8, it is obvious that the signals corresponding to the odd-numbered scanning lines are applied before the even-numbered scanning line signals. The brightness level of cells of two hundred and forty (240) odd-numbered scanning lines are addressed in an address period of the odd-numbered scanning lines, and each address period is followed by a sustain period in order to display the image signals. Similarly, the brightness level of cells of two hundred and forty (240) even-numbered scanning lines are addressed in an address period of the even-numbered scanning lines, and each address period of the even-numbered scanning lines is followed by a sustain period in order to display the image signals. A reset period is defined between the sustain period of the odd-numbered scanning lines and the address period of the even-numbered scanning lines in order to prevent the miss firing pixels during the address period of the even-numbered scanning lines.

Figure 9:
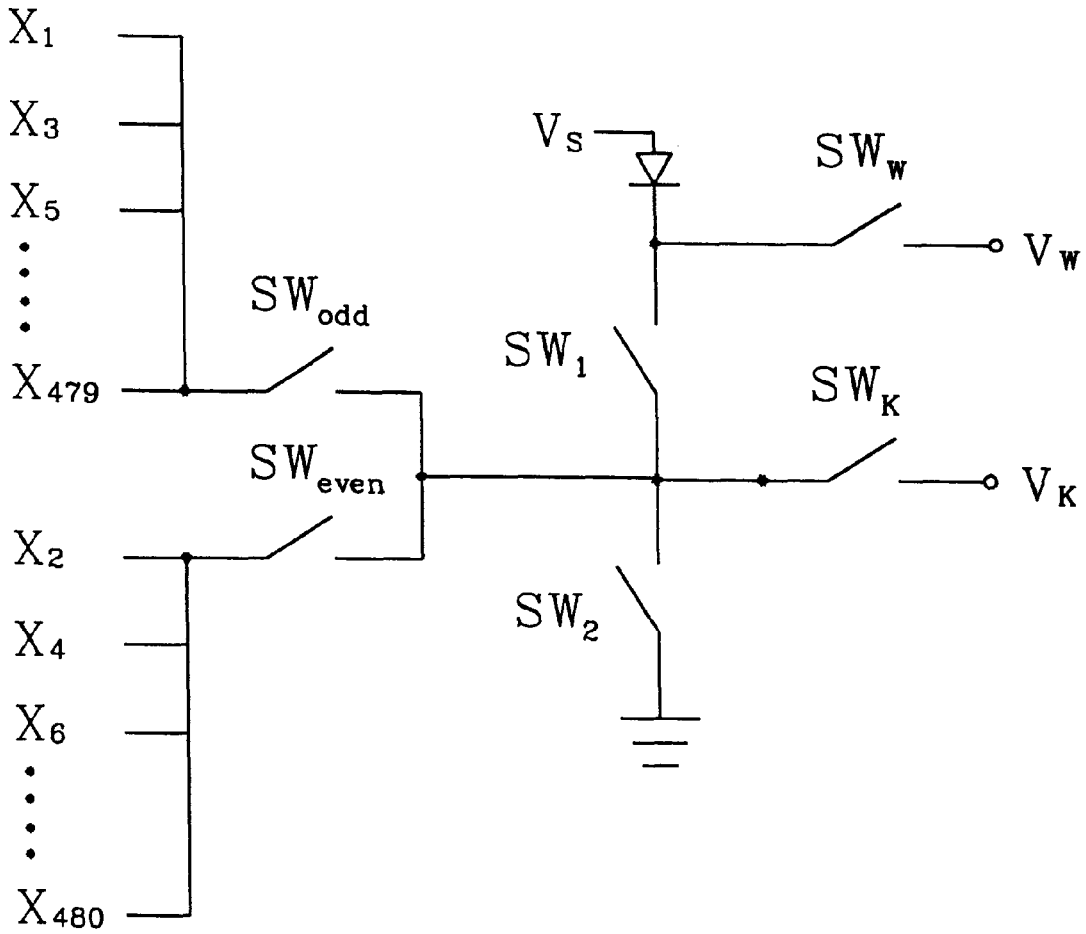
FIG. 9 is a schematic circuit diagram illustrating a simplified scanning driver for sustaining scanning lines in accordance with the present invention.

Further, the sustain driver 15 of the present invention can be simplified. As shown in FIG. 9, the circuit includes a pair of odd/even switches $SW_{odd}$ and $SW_{even}$ that are connected in parallel and are further connected to a set of serially connected switches $SW_1$ and $SW_2$. The output signals of the sustain driver of sustaining odd-numbered scanning lines 16, including $X_1$, $X_3$, . . . , $X_{479}$, are connected with the switch $SW_{odd}$. The output signals of the sustain driver of sustaining even-numbered scanning lines 18, including $X_2$, $X_4$, . . . , $X_{480}$, are connected with the switch $SW_{even}$. One end of the signal switch $SW_1$ is connected to a diode that is serially connected to the voltage source $V_S$, and one end of the signal switch $SW_2$ is connected to the ground. Afterwards, $SW_1$ and $SW_2$ are connected respectively to switches $SW_W$ and $SW_K$, which are further connected respectively to the voltage signals $V_W$ and $V_K$.

As discussed so far, the present invention relates to a method for driving plasma display to improve the dynamic false contour and reduce the abrupt change of image brightness. In the present invention, sub-fields for displaying one frame are applied in different way. The sub-fields in all cells of the odd-numbered displaying lines are reset, addressed, and sustained first. Thereafter, the sub-fields in all cells of the even-numbered displaying lines are reset, addressed, and sustained. Therefore, two adjacent frames will not be shown one by one. When the image is moving and the brightness level of the image is changed from brightness level 128 to 127, the abrupt change of image brightness will not easily appear because the brightness level of the image is not directly changed from brightness level 128 to 127. Therefore, the dynamic false contour in a certain part of the image will not appear.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A method for driving a plasma display panel having a first substrate and a second substrate facing each other, at least two scanning lines formed on said first substrate and sequentially numbered as either one of an odd-numbered scanning line and an even-numbered scanning line, each of the scanning lines having a first electrode and a second electrode disposed in parallel with each other, and a plurality of third electrodes disposed on said second substrate and extending orthogonally to said first and second electrodes for defining a cell among each set of first, second, and third electrodes, said first electrode and said second electrode of said odd-numbered scanning line being defined as an odd-numbered first electrode and an odd-numbered second electrode, said first electrode and said second electrode of said even-numbered scanning line being defined as an even-numbered first electrode and an even-numbered second electrode, in which a light emission is executed by carrying out an addressing discharge utilizing a memory function for cells of said two scanning lines and by carrying out a sustain discharge for sustaining said addressing discharge, wherein said method comprising following steps:

(a) executing a reset discharge for all cells of said odd-numbered scanning line by applying reset signals on said odd-numbered first electrode and said odd-numbered second electrode;

(b) executing said addressing discharge for all cells of said odd-numbered scanning line selected by either one of said odd-numbered first electrode and said odd-numbered second electrode to receive addressing signals from said third electrode;

(c) executing said sustaining discharge for all cells of said odd-numbered scanning line by alternatively applying driving signals on either one of said odd-numbered first electrode and said odd-numbered second electrode;

(d) executing a reset discharge for all cells of said even-numbered scanning line by applying reset signals on said even-numbered first electrode and said even-numbered second electrode;

(e) executing said addressing discharge for all cells of said even-numbered scanning line selected by either one of said even-numbered first electrode and said even-numbered second electrode to receive addressing signals from said third electrode; and (f) executing said sustaining discharge for all cells of said even-numbered scanning line by alternatively applying driving signals on either one of said even-numbered first electrode and said even-numbered second electrode.

2. A method for driving a plasma display panel having a first substrate and a second substrate facing each other, at least two scanning lines formed on said first substrate and sequentially numbered as either one of an odd-numbered scanning line and an even-numbered scanning line, each of the scanning lines having a first electrode and a second electrode disposed in parallel with each other, and a plurality of third electrodes disposed on said second substrate and extending orthogonally to said first and second electrodes for defining a cell among each set of first, second, and third electrodes, said first electrode and said second electrode of said odd-numbered scanning line being defined as an odd-numbered first electrode and an odd-numbered second electrode, said first electrode and said second electrode of said even-numbered scanning line being defined as an even-numbered first electrode and an even-numbered second electrode, in which a light emission is executed by carrying out an addressing discharge utilizing a memory function for cells of said two scanning lines and by carrying out a sustain discharge for sustaining said addressing discharge, wherein said method comprising following steps:

(a) executing a reset discharge for all cells of said even-numbered scanning line by applying reset signals on said even-numbered first electrode and said even-numbered second electrode;

(b) executing said addressing discharge for all cells of said even-numbered scanning line selected by either one of said even-numbered first electrode and said even-numbered second electrode to receive addressing signals from each third electrode;

(c) executing said sustaining discharge for all cells of said even-numbered scanning line by alternatively applying driving signals on either one of said even-numbered first electrode and said even-numbered second electrode;

(d) executing a reset discharge for all cells of said odd-numbered scanning line by applying reset signals on said odd-numbered first electrode and said odd-numbered second electrode;

(e) executing said addressing discharge for all cells of said odd-numbered scanning line selected by either one of said odd-numbered first electrode and said odd-numbered second electrode to receive addressing signals from each third electrode; and (f) executing said sustaining discharge for all cells of said odd-numbered scanning line by alternatively applying driving signals on either one of said odd-numbered first electrode and said odd-numbered second electrode.

3. A method for driving a plasma display panel having a first substrate and a second substrate facing each other, at least two scanning lines formed on said first substrate and sequentially numbered as either one of an odd-numbered scanning line and an even-numbered scanning line, each of the scanning lines having a first electrode and a second electrode disposed in parallel with each other, and a plurality of third electrodes disposed on said second substrate and extending orthogonally to said first and second electrodes for defining a cell among each set of first, second, and third electrodes, said cell of said odd-numbered scanning line being defined as an odd-numbered cell, said cell of said even-numbered scanning line being defined as an even-numbered cell, in which a brightness level of said cells is determined by applying at least a long sustaining period sub-field signal and a short sustaining period signal, wherein said method comprising sequentially executing following steps:

(a) applying the short sustaining period sub-field signal onto said cell of said odd-numbered display line;

(b) applying the long sustaining period sub-field signal onto said cell of said even-numbered display line;

(c) applying the long sustaining period sub-field signal onto said cell of said odd-numbered display line; and (d) applying the short sustaining period sub-field signal onto said cell of said even-numbered display line.

* * * * *